US005291638A

United States Patent [19]

Huang

[11] Patent Number: 5,291,638

[45] Date of Patent: Mar. 8, 1994

[54] TIGHTENING UP DEVICE

[76] Inventor: Han-Ching Huang, No. 12, Alley 111, Lane 437, Chen Hsing Rd., Taichung, Taiwan

[21] Appl. No.: 28,412

[22] Filed: Mar. 9, 1993

[51] Int. Cl.[5] ..... A44B 11/00

[52] U.S. Cl. ..... 24/170; 24/191

[58] Field of Search ..... 24/170, 191, 164, 168, 24/585

[56] References Cited

U.S. PATENT DOCUMENTS

| | | | |
|---|---|---|---|
| 1,387,919 | 8/1921 | Buchsbaum | 24/191 |
| 2,998,626 | 9/1961 | Prete, Jr. | 24/170 |
| 4,233,713 | 11/1980 | Berg | 24/170 |
| 4,787,266 | 11/1988 | Romano | 24/170 |

FOREIGN PATENT DOCUMENTS

| | | | |
|---|---|---|---|
| 0192159 | 11/1956 | Austria | 24/170 |
| 1411137 | 8/1965 | France | 24/170 |

*Primary Examiner*—Victor N. Sakran

*Attorney, Agent, or Firm*—Welsh & Katz, Ltd.

[57] ABSTRACT

A strap tightening up device includes a U-shaped body, a pin fixed in the body, a clamping element including a cam portion rotatably engaging with the pin, a spring for biasing the clamping element to rotate in one direction, a resilient plate disposed between the cam portion and the body and stretched to closely contact the cam portion. The strap is solidly clamped between the cam portion and the body when the clamping element rotates in the one direction.

3 Claims, 3 Drawing Sheets

TIGHTENING UP DEVICE

BACKGROUND OF THE INVENTION

1. Field of the Invention

The present invention relates to a device, and more particularly to a tightening up device.

2. Description of the Prior Art

A typical tightening up device is shown in FIG. 4 and is provided for tightening up a strap, a cable or the like and comprises a U-shaped body 40 including an opening 41 formed in the bottom portion thereof, a strap or a cable 60 to be tightened being inserted through the opening 41 of the body 40, a clamping element 50 having a cam portion 51 pivotally supported in the body 40 at a pin element 42, a plurality of teeth or projections 511 formed on the outer peripheral portion for engagement with the strop 60, and a spring 421 engaged on the pin element 42 for biasing the clamping element 50. In operation, one end of the strap 60 which passes through the opening 41 is pulled away from the tightening up device, at this moment, the clamping element 50 is caused to rotate in the direction as indicated by the arrow by the engagement between the projections 511 and the strap 60, the strap 60 can be solidly clamped between the body 40 and the cam portion 51 of the clamping element 50. However, obviously, the strap 60 will be easily damaged by the projections 511 when the strap 60 moves relative to the projections 511 of the cam portion 51.

The present invention has arisen to mitigate and/or obviate the afore-described disadvantages of the conventional tightening up device.

SUMMARY OF THE INVENTION

The primary objective of the present invention is to provide a tightening up device with which the straps will not be easily damaged.

In accordance with one aspect of the invention, there is provided a tightening up device for tightening a strap comprising a U-shaped body including a pin fixed therein and a bottom portion having an opening formed therein, a clamping element including a handle portion and a cam portion having a bore formed therein for rotatably engaging with the pin, means for biasing the clamping element to rotate in a direction such that the strap is clamped between the body and the cam portion of the clamping element, a resilient plate disposed between the cam portion and the body and including a first end fixed to the cam portion, and means for stretching the resilient plate such that the resilient plate closely contacts the cam portion, whereby, the strap is solidly clamped between the cam portion and the body when the clamping element rotate in the direction.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
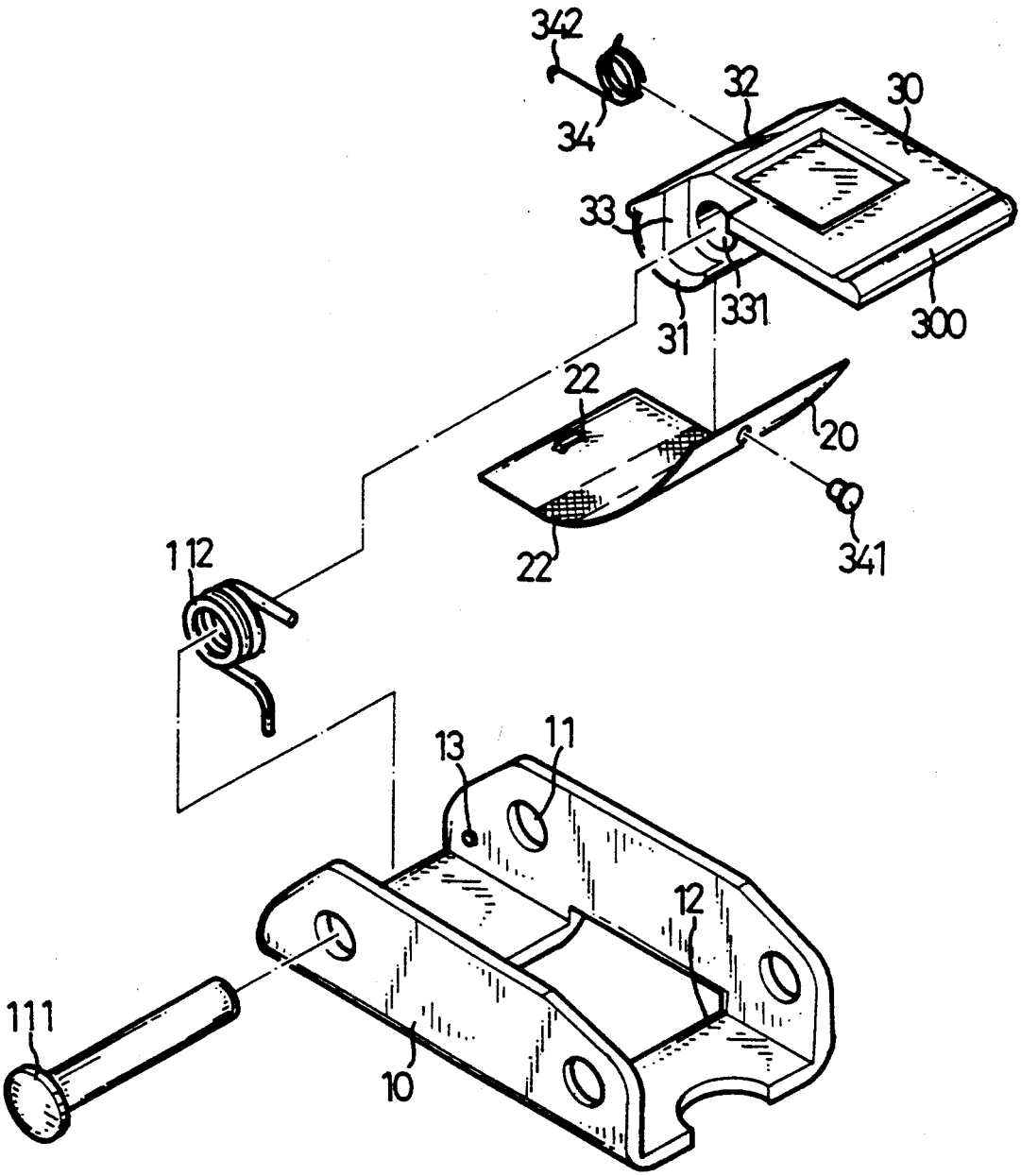
FIG. 1 is an exploded view of a tightening up device in accordance with the present invention.
Figure 2:
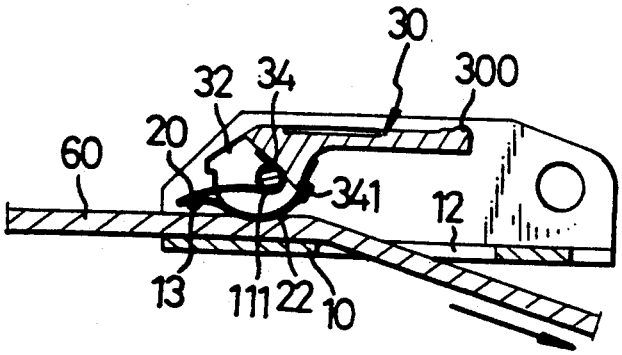
FIGS 2 and 3 are cross sectional views of the tightening up device.

Referring to the drawings, and initially to FIGS. 1 and 2, a tightening up device in accordance with the present invention comprises a U-shaped body 10 including an opening 12 formed in the bottom portion thereof, a pin 111 fixed in the body 10, a clamping element 30 including a cam portion 31 having a bore 331 formed therein for rotatably engaging on the pin 111 and including a handle portion 300, a slot 32 formed in the middle portion of the cam portion 31 and communicated with the bore 331, a spring 34 received in the slot 32 and engaged on the pin 111, and a notch 33 formed in one end of the cam portion 31 for receiving another spring 112, the spring 112 is arranged for biasing the clamping element 30 such that the handle portion 300 of the clamping element 30 rotates in a counterclockwise direction, when seeing from FIG. 2. The configuration disclosed hereinbefore is well known in the art and will not be described in further details.

A resilient plate 20 includes one end fixed to the cam portion 31 of the clamping element 30 by a rivet 341 and a hook 21 disposed on the other end thereof, the spring 34 includes one end 342 engaged with the hook 21 for holding, stretching or protracting the resilient plate 20 and arranged such that the resilient plate 20 closely contacts the lower peripheral portion of the cam portion 31. It is preferable that the resilient plate 20 includes a knurled surface 22, particularly the lower surface which faces toward the bottom of the body 10 or faces away from the cam portion 31. As shown in FIG. 2, a gap is formed between the cam portion 31 of the clamping element 30 and the bottom of the body 10, a strap 60 to be clamped is inserted through the gap and includes one end extended through the opening 12 of the body 10.

It is preferable that a pair of stops 13 extend inwards of the body 10 for supporting the other end of the resilient plate 20, such that the other end of the resilient plate 20 will not contact the strap 60, best shown in FIG. 2.

Figure 3:
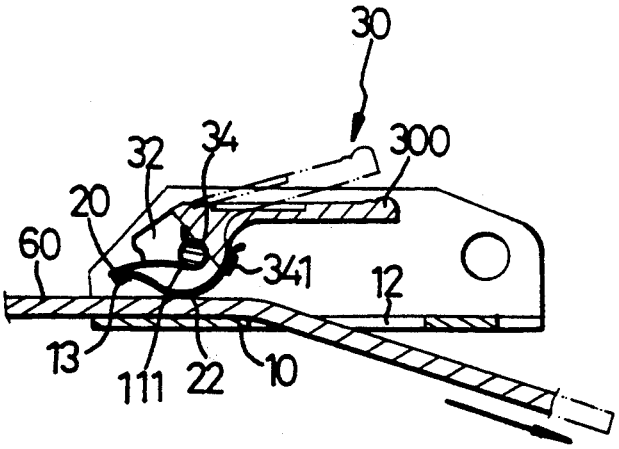
Figure 4:
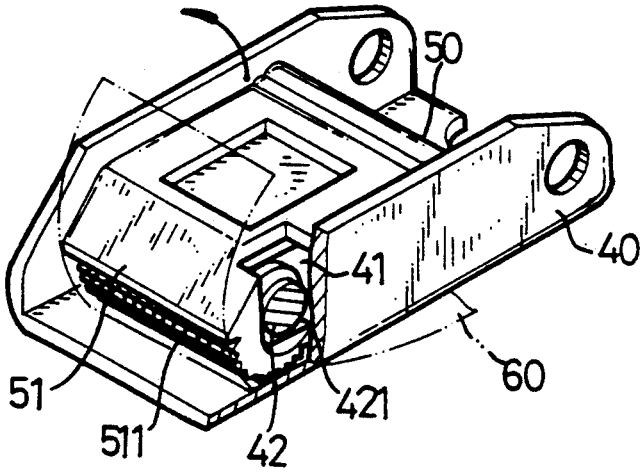
Fig. 4 PRIOR ART
FIG. 4 is a perspective view of the typical tightening up device, in which part of the tightening up device is cut off.

In operation, referring next to FIG. 3, when the one end of the strap 60 is pulled along the direction as indicated by the arrow, the handle portion 300 of the clamping element 30 is caused to rotate in the counterclockwise direction against the biasing force of the spring 112, such that the strap 60 can be solidly clamped between the body 10 and the resilient plate 20 and the cam portion 31 of the clamping element 30.

It is to be noted that the cam portion 31 has no projections formed thereon, the strap 60 contacts the knurled surface 22 of the resilient plate 20 such that the strap 60 will not be easily damaged by the tightening up device in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tightening up device for tightening a strap comprising a U-shaped body including a pin fixed therein and a bottom portion having an opening formed therein, a clamping element including a handle portion and a cam portion having a bore formed therein for rotatably engaging with the pin, said cam portion including a middle portion having a slot formed therein, means for biasing said clamping element to rotate in a direction such that said strap is clamped between said body and said cam portion of said clamping element, a resilient plate disposed between said cam portion and said body and including a first end fixed to said cam portion, and means for stretching said resilient plate such that said resilient plate closely contact said cam portion, said stretching means including a spring received in said slot of said cam portion and engaged with said pin, said spring including a first end engaged with said clamping element and a second end coupled to a second end of said resilient plate so s to stretch said resilient plate, whereby said strap is solidly clamped between said cam portion and said body when said clamping element rotates in said direction.

2. A device according to claim 1, wherein said resilient plate includes a knurled lower surface.

3. A device according to claim 1, wherein said body includes at least one stop provided therein, said second end of said resilient plate is engageable with said stop such that said second end of said resilient plate is prevented from engaging with said strap.

* * * * *